US009121207B2

(12) United States Patent
Stuart

(10) Patent No.: US 9,121,207 B2
(45) Date of Patent: Sep. 1, 2015

(54) HINGE

(76) Inventor: Michael Christopher Stuart, Balmain (AU)

( * ) Notice: Subject to any disclaimer, the term of this patent is extended or adjusted under 35 U.S.C. 154(b) by 211 days.

(21) Appl. No.: 13/057,405

(22) PCT Filed: Aug. 6, 2008

(86) PCT No.: PCT/AU2008/001139

§ 371 (c)(1),
(2), (4) Date: Feb. 3, 2011

(87) PCT Pub. No.: WO2009/018615

PCT Pub. Date: Feb. 12, 2009

(65) Prior Publication Data

US 2011/0138572 A1 Jun. 16, 2011

Related U.S. Application Data

(60) Provisional application No. 60/954,254, filed on Aug. 6, 2007.

(51) Int. Cl.
*E05D 5/02* (2006.01)
*E05D 11/10* (2006.01)
(Continued)

(52) U.S. Cl.
CPC ..... *E05D 5/0246* (2013.01); *E05D 3/12* (2013.01); *E05D 11/1014* (2013.01); *E05D 11/1078* (2013.01); *E05F 1/1215* (2013.01); *E05F 3/20* (2013.01); *E05D 3/02* (2013.01);
(Continued)

(58) Field of Classification Search
CPC ..... Y10T 16/5401; Y10T 16/2771; Y10T 16/304; Y10T 16/5385; Y10T 16/5402; Y10T 16/61; Y10T 16/625; Y10T 16/534; Y10T 16/2788; Y10T 16/53888; Y10S 16/14; E05D 3/03; E05D 3/12; E05D 2003/027; E05D 5/0246; E05D 11/1014; E05D 11/1078; E05F 1/1008; E05F 1/1207; E05F 1/1215; E05F 3/20; E05Y 2201/21; E05Y 2201/218; E05Y 2201/256
USPC ..... 16/58, 307, DIG. 14
See application file for complete search history.

(56) References Cited

U.S. PATENT DOCUMENTS 2,883,699 A 4/1959 Gross
3,707,017 A 12/1972 Paquette
(Continued)

FOREIGN PATENT DOCUMENTS

DE 8536706 7/1987
DE 10 2005 005 139 8/2006
(Continued)

OTHER PUBLICATIONS

English translation of Notice of Preliminary Rejection, dated Jun. 27, 2014, for Korean Patent Application No. 10-2011-7002336 (6 pages).

*Primary Examiner* — William Miller
(74) *Attorney, Agent, or Firm* — Wolf, Greenfield & Sacks, P.C.

(57) ABSTRACT

A hinge including a first hinge member including a first magnetic element; and a second hinge member including a second magnetic element, wherein the first and second hinge members are hingedly mounted to each other. The first and second hinge members are substantially maintained in a retained position via magnetic force between the first and second magnetic elements.

20 Claims, 19 Drawing Sheets

(51) Int. Cl.

| | |
|---|---|
| ***E05D 3/12*** | (2006.01) |
| ***E05F 1/12*** | (2006.01) |
| ***E05F 3/20*** | (2006.01) |
| *E05D 3/02* | (2006.01) |

(52) U.S. Cl.

CPC ..... *E05D2003/027* (2013.01); *E05Y 2201/21* (2013.01); *E05Y 2201/218* (2013.01); *E05Y 2201/256* (2013.01); *E05Y 2201/46* (2013.01); *Y10T 16/2771* (2015.01); *Y10T 16/304* (2015.01); *Y10T 16/5401* (2015.01)

(56) References Cited

U.S. PATENT DOCUMENTS

| | | | | |
|---|---|---|---|---|
| 3,896,404 | A | 7/1975 | Peterson | |
| 4,072,917 | A | 2/1978 | Haag et al. | |
| 4,953,261 | A * | 9/1990 | Lyons | 16/354 |
| 5,076,623 | A | 12/1991 | Richards | |
| 5,953,771 | A * | 9/1999 | VanHuss | 4/609 |
| 6,408,484 | B1 | 6/2002 | Vandertouw | |
| 6,577,235 | B2 | 6/2003 | Frys | |
| 6,721,994 | B2 | 4/2004 | Bowman et al. | |
| 7,089,627 | B2 | 8/2006 | Seidler | |
| 7,945,997 | B2 * | 5/2011 | Wang | 16/320 |
| 8,015,666 | B2 * | 9/2011 | Wang | 16/320 |
| 2004/0134030 | A1 | 7/2004 | Seidler | |
| 2007/0151077 | A1 | 7/2007 | Wei et al. | |
| 2007/0157432 | A1 | 7/2007 | Weinstein | |

FOREIGN PATENT DOCUMENTS

| | | | |
|---|---|---|---|
| DE | 10 2005 005139 | A1 | 8/2006 |
| EP | 0615716 | A1 | 2/1994 |
| GB | 2 180 297 | A | 3/1987 |
| JP | 06-341277 | | 12/1994 |
| JP | 08-158728 | | 6/1996 |
| JP | 08-193457 | | 7/1996 |
| JP | H10 184173 | A | 7/1998 |
| JP | 00-129995 | | 5/2000 |
| JP | 05-256583 | | 9/2005 |
| KR | 20-0410197 | | 3/2006 |
| WO | WO 97/05356 | | 2/1997 |
| WO | WO 03/052225 | A1 | 6/2003 |
| WO | 2007/028400 | A1 | 3/2007 |
| WO | WO 2007/028400 | A1 | 3/2007 |
| WO | WO 2007/126210 | A1 | 11/2007 |

* cited by examiner

HINGE

TECHNICAL FIELD

The present invention relates to magnetic hinges.

BACKGROUND ART

A conventional hinge generally includes a pair of hinge plates pivotably secured together by a hinge pin enabling movement of the hinge plates relative to each other. One common use of a traditional hinge is in the use of pivotably mounting a door. Generally hinges are neither monostable nor bistable in that the hinge does not favour or does not bias toward a particular position or orientation.

However, in particular applications, such as hinges for shower doors, it is desirable to provide a hinge which maintains and/or biases the hinge plates to one or more positions.

One known hinge includes a hinge pin including a flattened surface portion which operatively interacts with a spring in order to maintain the hinge plates in a defined orientation. In particular, one end of the spring biases against the circumferential surface of the pin which is generally circular except for the flattened surface portion. When the hinge members move relative to one another, the hinge pin rotates relative to the spring. When the hinge plates are moved to the defined position, the flattened surface portion of the hinge pin is butted against the end of the spring. The torsional force in the spring substantially maintains the spring in a butted position against the flattened surface portion of the hinge pin, thereby substantially maintaining the hinge in the defined position.

However, problems can occur with such an arrangement. In particular, due to the end of the spring being in continual contact with the circumferential surface of the hinge pin whilst moving between positions, the end of the spring continually rubs against the surface of the hinge pin. Over an extended period of time and use, the frictional movement of the end of the spring against the hinge pin causes the flattened surface portion to round, thereby reducing, and in some instances eliminating, the retention of the hinge plates in the defined position.

Therefore there exist a need for a hinge which is able to maintain a hinge in a retained position which overcomes or at least ameliorates one or more of the above problems.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

DISCLOSURE OF INVENTION

In one broad form there is provided a hinge including:

a first hinge member including a first magnetic element; and a second hinge member including a second magnetic element, wherein the first and second hinge members are hingedly mounted to each other;

wherein the first and second hinge members are substantially maintained in a retained position via magnetic force between the first and second magnetic elements.

In one form, the first and second magnetic elements bias the first and second hinge members to the retained position.

In another form, the hinge includes:

a dampening mechanism protruding from the second hinge member; and an overlapping portion extending from the first hinge member, wherein when the first and second hinge members pivot relative to each other toward the retained position, the overlapping portion urges against the dampening mechanism, thereby slowing the movement of the first hinge member and the second member to the retained position.

In an optional form, the dampening mechanism is a hydraulic mechanism.

In another optional form, the hydraulic mechanism includes a hydraulic piston which substantially protrudes from the second hinge member, and wherein when the first and second hinge elements move toward the retained position, the overlapping portion urges against the hydraulic piston which gradually retracts into a hydraulic cylinder of the hydraulic mechanism.

Optionally, the hydraulic mechanism is spring loaded to eject a portion of the piston from the cylinder once the first and second hinge members move from the retained position to an unretained position.

In one embodiment, the hinge includes a joining member which pivotally joins the first hinge member to the second hinge member.

In another embodiment, a first retaining pin extends through and is releasably retained within a first hollow of the joining member to thereby releasably secure the joining member in pivotal connection, about the first retaining pin, with the first hinge member.

In one form, the first retaining pin supports a spring, wherein a first end of the spring is attached to the retaining pin and a second end of the spring butts against a stop surface of the joining member, wherein pivotal movement of the first and second members away from the retained state causes a torsional force to build in the spring, thereby biasing the first and second hinge members toward the retained position.

In another form, a second retaining pin extends through and is releasably retained within a second hollow of the joining member to thereby releasably fix the joining member to the second hinge member.

In one embodiment, the joining member includes a third magnetic element, wherein magnetic force between the first magnetic element and the third magnetic element biases the first hinge member and second hinge member toward the retained position.

In another embodiment, the first hinge member includes a first hinge front plate and a first hinge rear plate which are releasably secured together, and the second hinge member includes a second hinge front plate and a second hinge rear plate which are releasably secured together.

In an alternate embodiment, the first and second hinge members are moveable to an unstable position wherein magnetic force between the first and second elements bias the first a second hinge members to move from the unstable position to the retained position.

In an alternate embodiment, the first and second hinge members are movable to an unstable position wherein magnetic force between the first and second elements bias the first and second hinge members to move from the unstable position to the retained position.

In one embodiment, the first and second hinge members are movable to an unstable position wherein magnetic force between the first and second elements bias the first and second hinge members to move from the unstable position to the retained position.

In another embodiment, the first and second hinge members are movable to a range of freely movable positions wherein the magnetic force between the first and second magnetic elements fail to retain and/or bias the first and second hinge elements.

In one form, the first and second magnetic elements are of opposite polarity such that the first and second magnetic elements are attracted to each other.

In another form, the first hinge member includes at least one aperture to receive and retain the first magnetic element.

In one embodiment, the second hinge member includes at least one aperture to receive and retain the second magnetic element.

In another optional form, the first hinge member includes an arm which extends from a first hinge body of the first hinge member, and the second hinge member includes a pair of arms which extend from a second hinge body, wherein the pair of arms define a recess which corresponds to the arm of the first hinge member, wherein the arms of the first and second hinge members include the first and second magnetic elements respectively.

In one embodiment, the first and second magnetic elements retained by the arms of the first and second hinge members are superposed when the first and second hinge members are maintained in the retained position.

In another optional form, the first and second hinge members are movable to a range of freely moveable positions wherein the magnetic force between the first and second magnetic elements fail to retain and/or bias the first and second hinge elements.

BRIEF DESCRIPTION OF FIGURES

The example embodiment of the present invention should become apparent from the following description, which is given by way of example only, of a preferred but non-limiting embodiment, described in connection with the accompanying figures.

MODES FOR CARRYING OUT THE INVENTION

The following modes, given by way of example only, are described in order to provide a more precise understanding of the subject matter of a preferred embodiment or embodiments.

Figure 1:
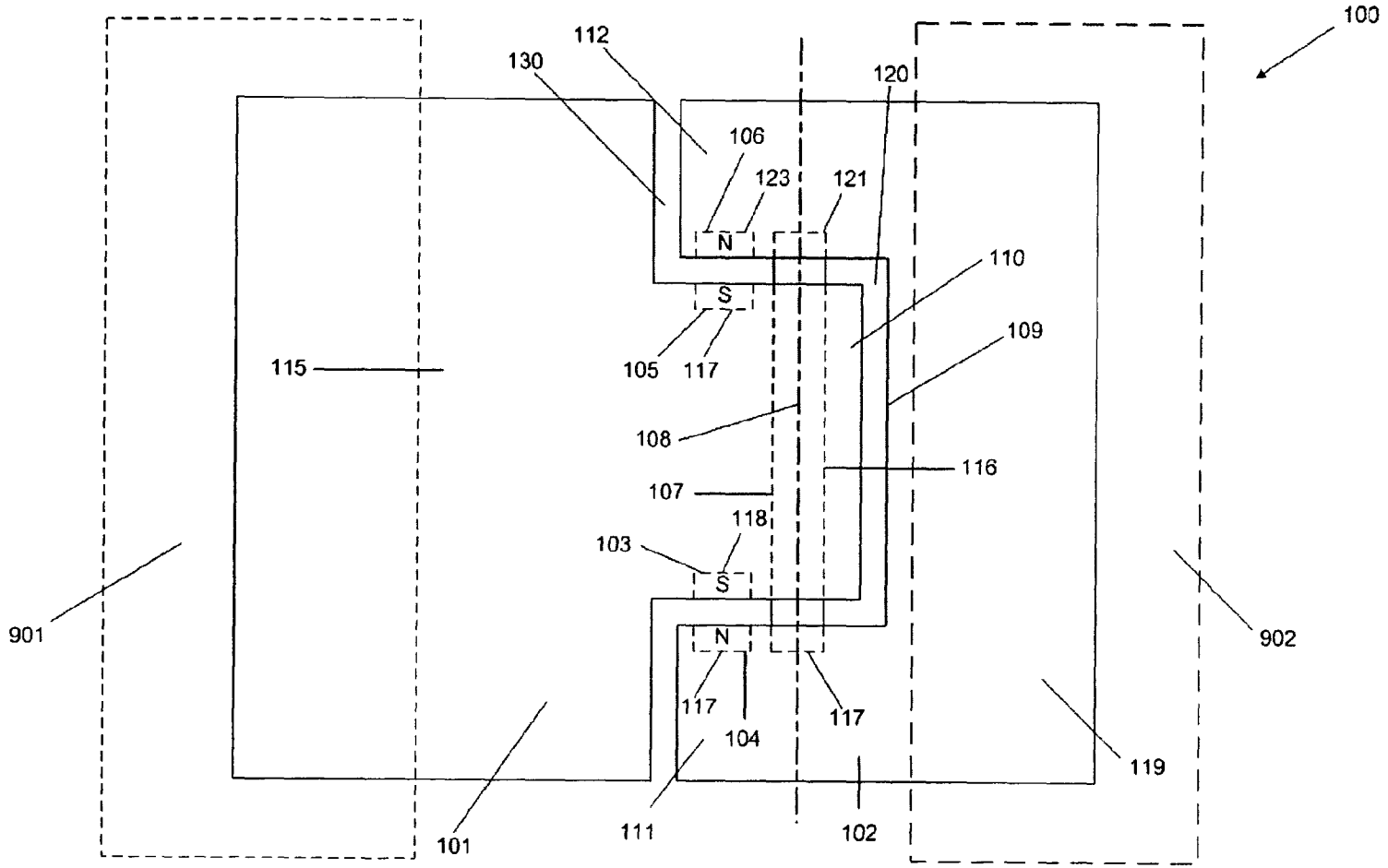
FIG. 1 illustrates a side view of a hinge wherein a respective hinge members are coupled to door elements, and wherein the hinge is in the retained position.

Referring to FIG. 1 there is shown a hinge 100 including a first hinge member 101 including at least one first magnetic element 103, 105, and a second hinge member 102 including at least one second magnetic element 104, 106, wherein the first and second hinge members 101, 102 are hingedly mounted. The first and second hinged members 101, 102 are substantially maintained in a retained position, as shown in FIG. 2, via magnetic force between the first and second magnetic elements 103, 104, 105 and 106.

Figure 2:
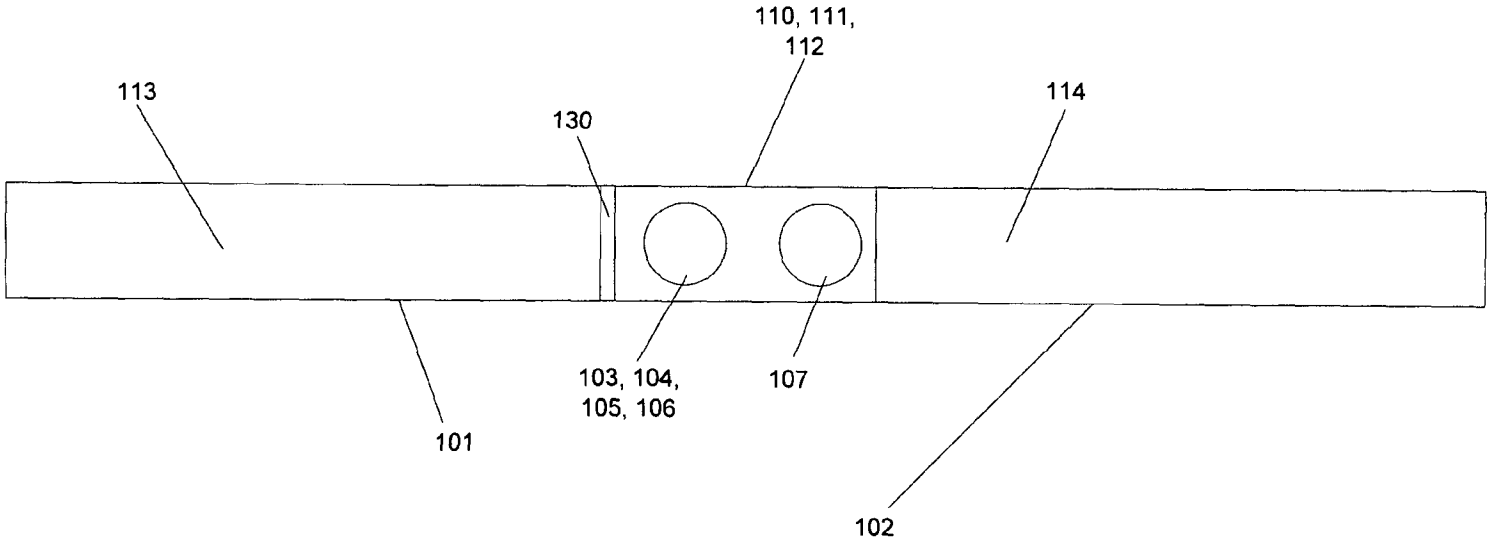
FIG. 2 illustrates a top view of the hinge of FIG. 1, excluding the door members, wherein the hinge is in the retained position.
Figure 3:
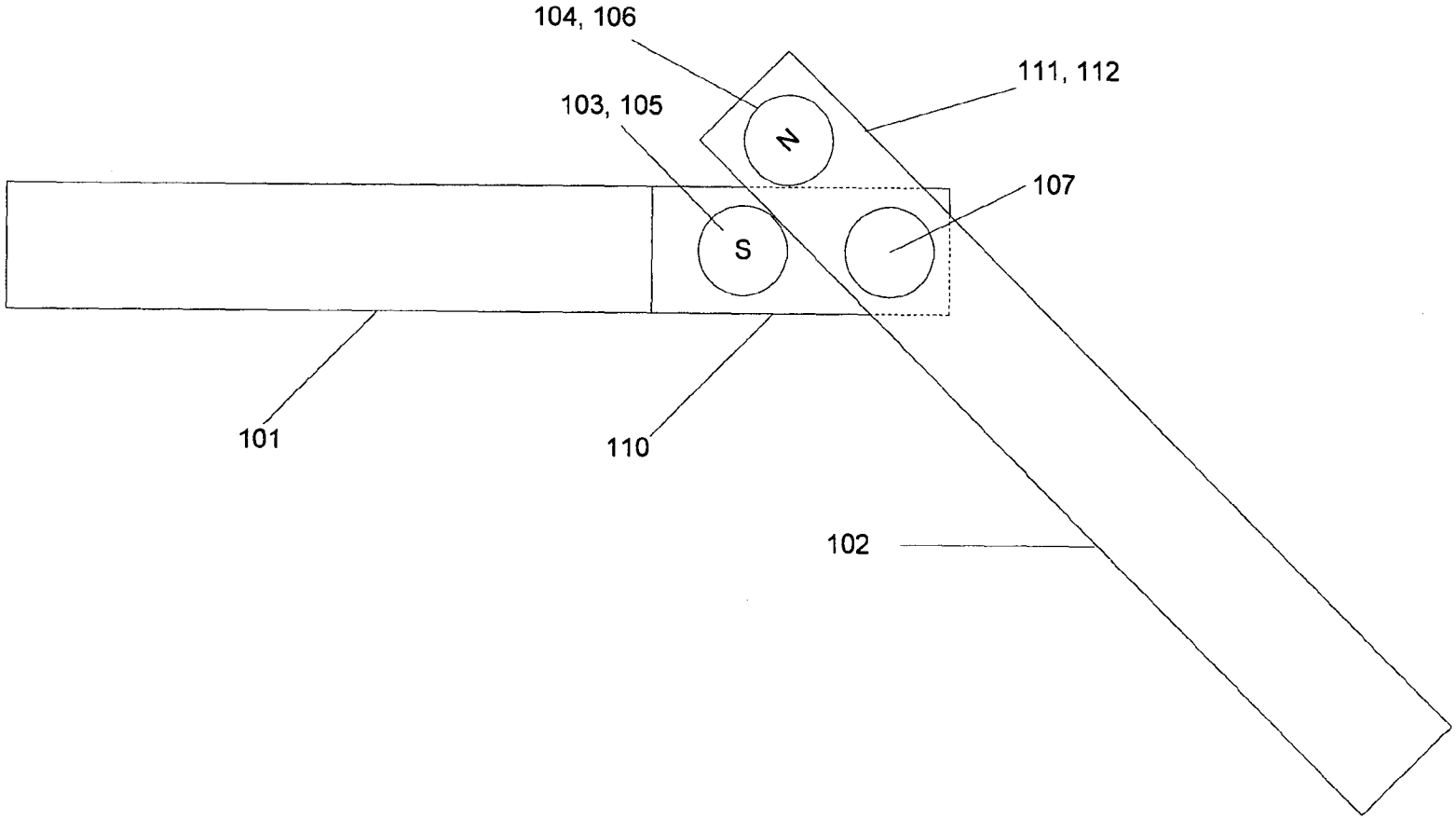
FIG. 3 illustrates a top view of the hinge of FIG. 1, excluding the door members, in an unstable position.

As shown in FIG. 3, the first and second hinge members 101, 102 are movable to an unstable position wherein magnetic force between the first and second magnetic elements 103, 104, 105, 106 bias the first and second hinge members 101, 102 to move from the unstable position to the retained position as illustrated in the top view of FIG. 2.

Figure 4:
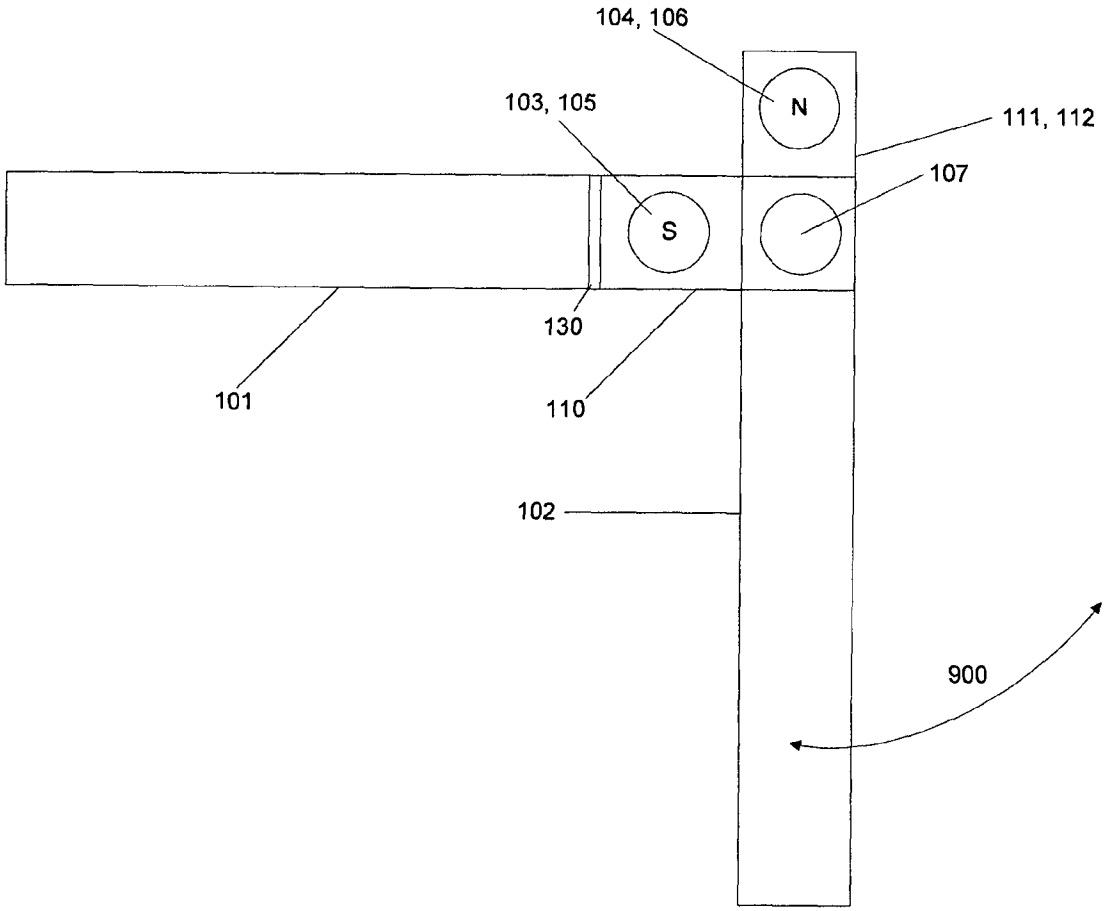
FIG. 4 illustrates the hinge of FIG. 1, excluding the door members, in a freely movable position.

Referring to FIG. 4, the first and second hinge members 101, 102 are movable to at least one freely movable position wherein the first and second magnetic elements 103, 104, 105, 106 fail to bias or maintain the hinge members 101, 102 in a defined orientation relative to each other.

Referring again to FIG. 1, the first hinge member 101 includes a hinge body 115 which includes an extending arm 110. The arm 110 includes an aperture 116 which allows a hinge pin 107 to protrude therethrough. The arm 110 also includes at least one magnetic element aperture 117, 118, wherein each magnetic element aperture 117, 118 retains a respective one of the magnetic elements 103, 105.

The second hinge member 102 includes hinge body 119 and a pair of arms 111, 112 which extend therefrom and define a recess portion 120 which substantially corresponds to the arm 110 of the first hinge member 101. The first and second arms 111, 112 each include a hinge pin aperture 121, 122 which receive and retain at least a respective portion of the hinge pin 107 which protrudes through the arm 110 of the first hinge member 101, thereby pivotably mounting the first and second hinge members 101, 102 via the hinge pin 107 such that the first and second hinge members 101, 102 hingedly move about hinge axis 108.

The first and second arms 111, 112 of the second hinge member also include respective magnetic element apertures 123, 124 which each receive and retain one of the second magnetic elements 104, 106.

As shown in FIGS. 1 and 2, when the first and second hinge members 101, 102 are maintained in the retained position, the first magnetic elements 103, 105 are superposed and aligned such that the close proximity between the first and second magnetic elements 103, 104, 105, 106 facilitate the retention of the first and second hinge members 101, 102 in the retained position.

As shown by example in FIG. 1, due to the first magnetic elements having a conventional south polarity and the second magnetic elements having a conventional north polarity, the first and second magnetic elements are magnetically attracted to each other to facilitate the retention of the first and second hinge members 101, 102 in the retained position.

Referring to FIG. 2, each hinge member 101, 102 includes a cavity 113, 114 which allows for door members 901, 902 (illustrated in dotted lines in FIG. 1) to be received and retained therein. In this particular instance, the hinge 100 is designed to couple to a frameless glass door for a shower.

Referring to FIG. 3, when the hinge members 101, 102 are moved to an unstable position, the proximity between the first and second magnetic elements 103, 104, 105, 106 is small enough such that the magnetic attraction between the magnetic elements 103, 104, 105, 106 biases the first and second hinge members 101, 102 to pivotally rotate about hinge pin 107 from the unstable position to the retained position as illustrated in FIGS. 1 and 2, wherein the first and second magnetic elements 103, 104, 105, 106 are in a superposed orientation.

Referring to FIG. 4, if the first and second hinge members 101, 102 are moved past the unstable position, the proximity between the first and second magnetic elements 103, 104, 105, 106 is of a distance which substantially reduces the magnetic force between the magnetic elements 103, 104, 105, 106 to bias the hinge members 101, 102 to the retained position, such that the hinge members 101, 102 are able to move within a range of freely movable positions as illustrated by arrow 900.

It will be appreciated that although the above described hinge 100 is configured to retain the hinge members 101, 102 in a retained position where the hinge members 101, 102 are parallel to each other as illustrated in FIG. 2, other arrangements are possible which result in the hinge being maintained is other desired retained positions.

Figure 5:
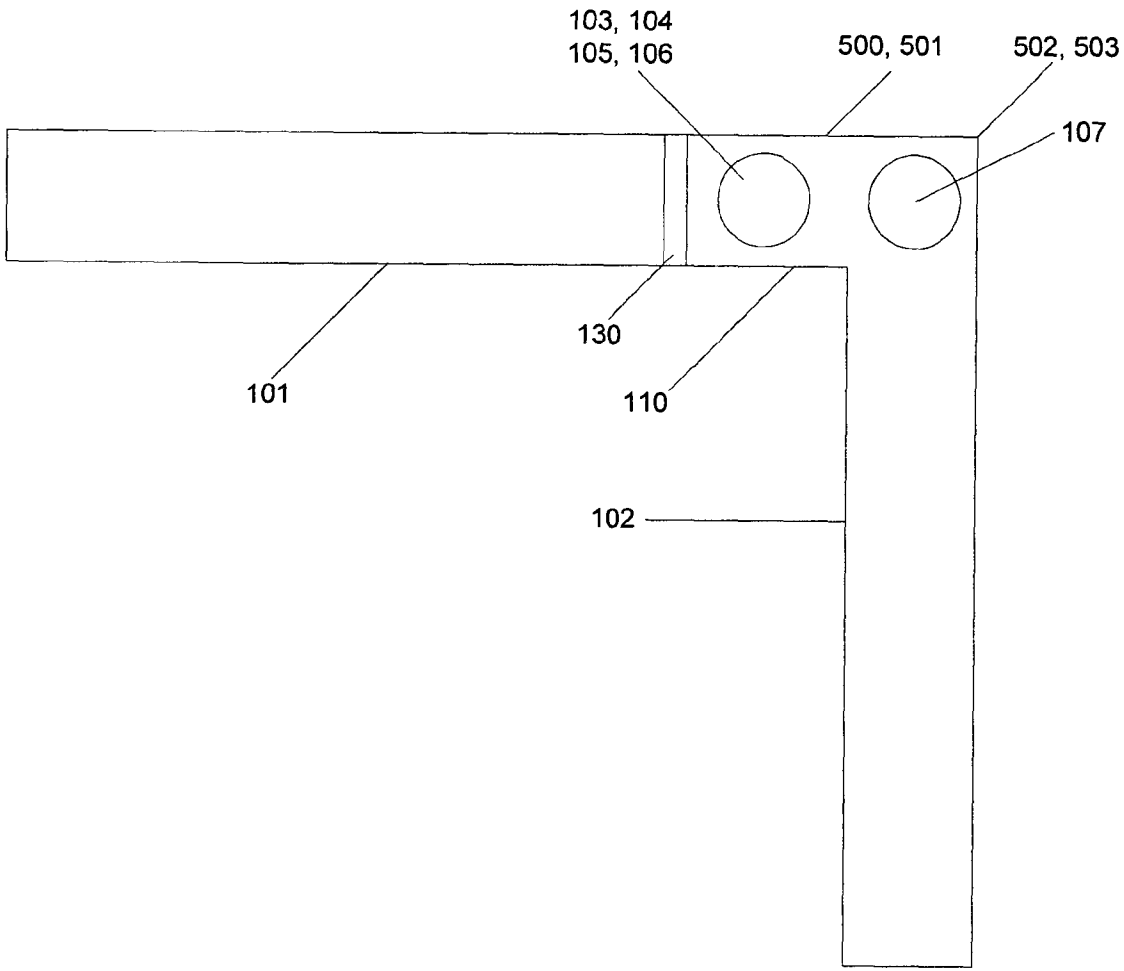
FIG. 5 illustrates a second example of a hinge which is in the retained position.
Figure 6:
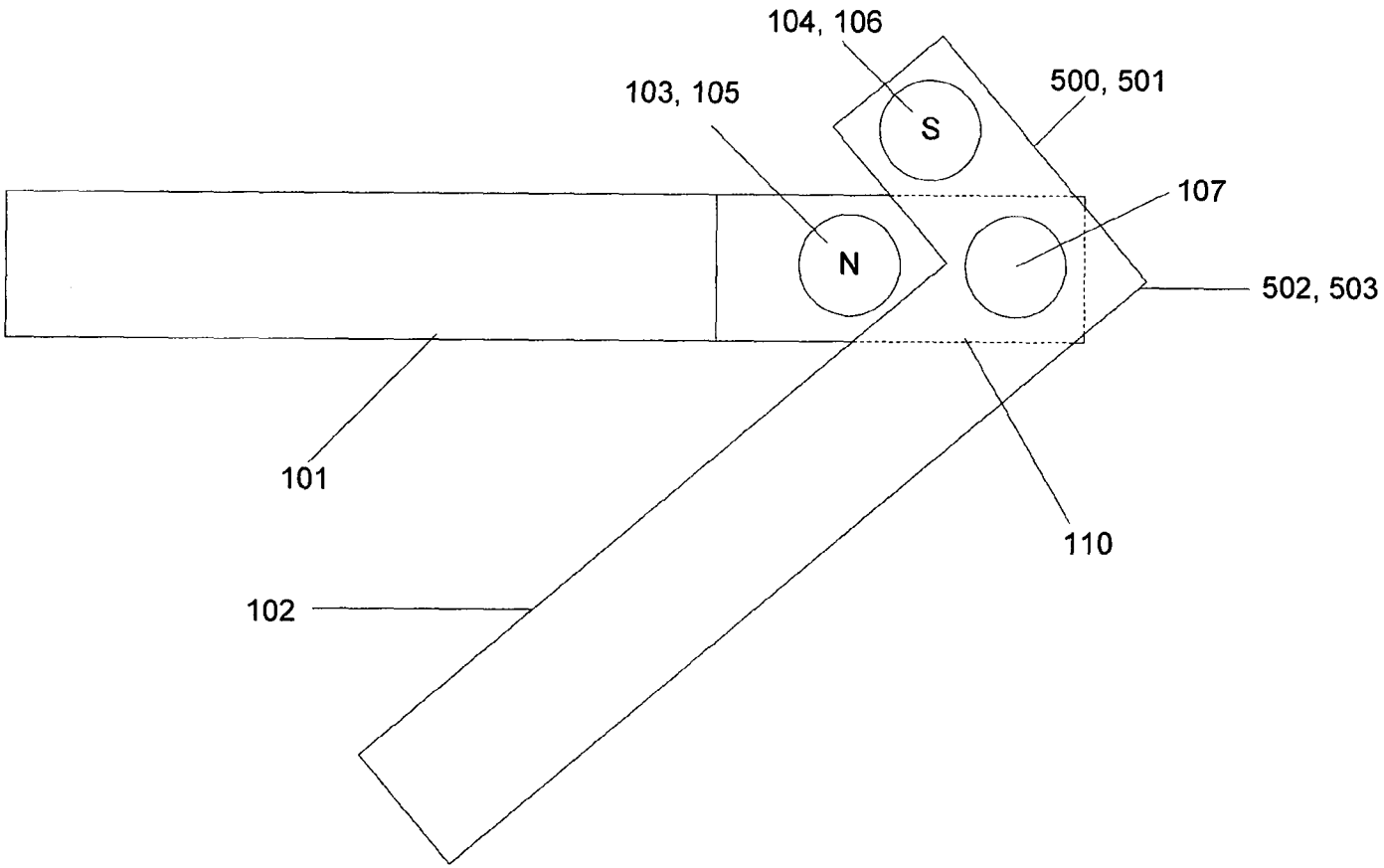
FIG. 6 illustrates the hinge of FIG. 5 in an unstable position.

For example, as illustrated in FIG. 5, one of the hinge members includes a pair of arms 500, 501 wherein each arm 500, 501 includes an elbow 502, 503 such that the first and second hinge members 101, 102 are maintained in a retained position where hinge body 115, 119 of the first and second hinge members 101, 102 are orthogonal to each other. As shown in FIG. 6, the hinge members 101, 102 can be moved to an unstable position wherein the magnetic elements 103, 104, 105, 106 bias the hinge members 101, 102 back to the retained position where the hinge bodies 115, 119 are orthogonally positioned relative to each other.

Figure 7:
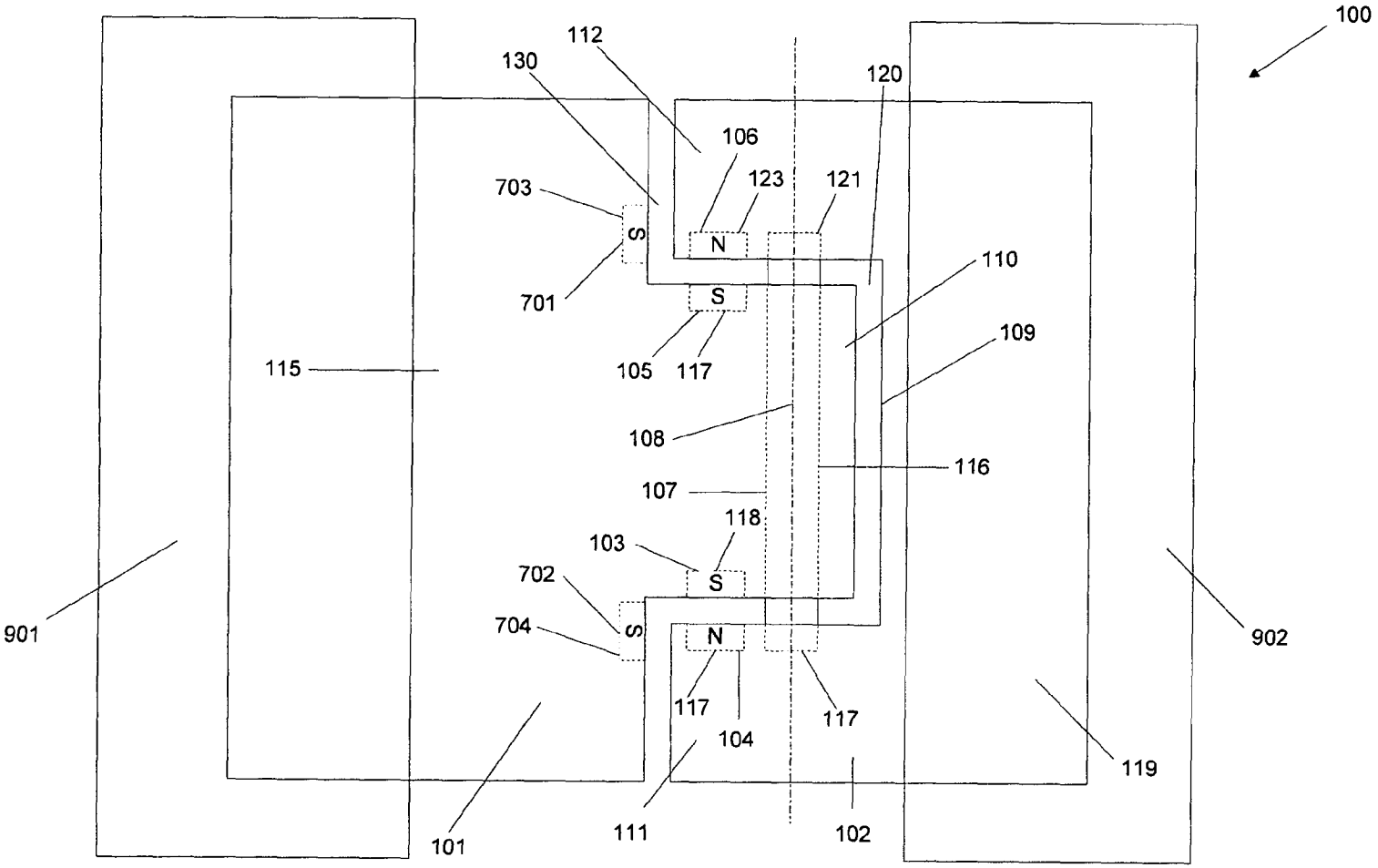
FIG. 7 illustrates another example of a hinge including additional magnetic elements.

Referring to FIG. 7 there is shown a further example of the hinge. In particular, the first hinge member 101 includes additional magnetic elements 702, 703 which are located at edges of the hinge body 115 to at least partially surround the second magnetic elements 104, 106 of the second hinge member. The additional magnetic elements 701, 702 are received and retained within additional magnetic element apertures 703, 704 respectively. The additional magnetic elements 702, 703 in combination with the first magnetic elements 103, 105 help maintain the hinge members in 101, 102 in the retained position by at least partially surrounding the second magnetic elements 104, 106.

As illustrated by example in FIGS. 2, 3 and 4, the magnetic elements 103, 104, 105, 106 have a circular cross section. However, it will be appreciated that other cross sectional profiles for the magnetic elements 103, 104, 105, 106 can be used.

The magnetic elements 103, 104, 105, 106 are preferably of small size but are of significant magnetic strengths and may be formed of alnico, neodymium (a rare earth metal) or like materials of high magnetic flux. Preferably the magnetic elements 103, 104, 105, 106 have sufficient magnetic strength that, in the absence of an intentional effort to move the door members coupled to the hinge members 102, 101, the hinge members 101, 102 are maintained in the retained position. That is, the magnetic elements 103, 104, 105, 106 are sufficiently strong to preclude movement of hinge members from the retained position to the unstable or free moving position.

In one form, the arms 110, 111, 112 of the hinge members 101, 102 include a series of magnetic elements of various strengths in order to control the speed which the hinge members 101, 102 move from the unstable position to the retained position. In one form, magnetic elements which are positioned closer to the edge of the respective arm are of weaker magnetic strength compared to more centrally located magnetic elements, wherein the differential in magnetic strength between the outer and centrally located magnetic elements facilitates controlling the speed of the movement of the hinge members 101, 102 from the unstable to retained position.

Although the above example has illustrated that the first magnetic element 103, 105 and the second magnetic element 104, 106 are of opposite magnetic polarities (ie. South and North respectively) such that the first and second magnetic elements 103, 104, 105, 106 are attracted to each other to cause the first and second hinge members 101, 102 to be substantially maintained in the retained position, an alternative embodiment includes providing the hinge with first and second magnetic elements which are of the same polarity. In this arrangement, a repulsive magnetic force between the first and second magnetic elements maintains and biases the hinge members 101, 102 in a defined retained position wherein the first and second magnetic elements are substantially non-overlapping such (i.e. the magnetic elements are not superposed).

Figure 8:
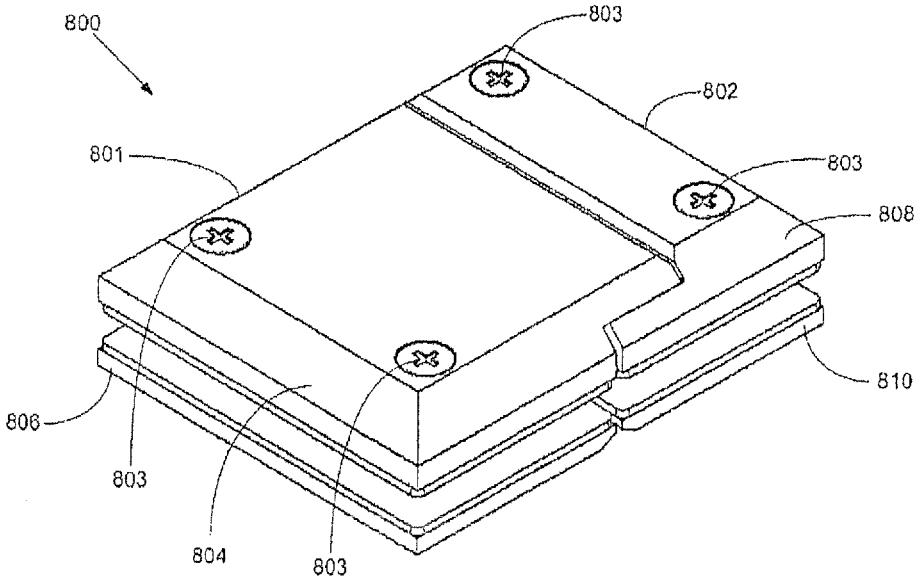
FIG. 8 illustrates a perspective drawing on another example of a hinge in a retained position.

Referring to FIG. 8 there is shown another example of a hinge 800. The hinge illustrated in FIG. 8 includes a biasing mechanism to bias the first and second hinge members 801, 802 from an unretained position to a retained position.

Referring to FIG. 8 in more detail, the first hinge member 801 includes a front plate 806 and a rear plate 804. The second hinge member 802 includes a front plate 810 and a rear plate 808. The front and rear plates 804, 806, 808, 810 of the first and second hinge members 801, 802 are separable via releasable screws 803, wherein the rear plates 804, 808 of each hinge member 801, 802 includes a plurality of holes 812, 814 for receiving therethrough one of the screws 803, and the inner surface of each front plate includes a respective threaded element 870 for receiving the tail of the screw 803 for releasable engagement.

Referring to FIGS. 8 to 13, the first hinge member includes an overlapping portion 807 which extends from the rear hinge plate 804 of the first hinge member 801 and overlaps a recessed portion 805 of the rear plate 808 of the second hinge member 802 in the retained position. Protruding from the recessed portion 805 of the rear plate 808 of the second hinge member 802 is one or more dampener elements 809 which are configured to slow movement of the hinge members 801, 802 from the unstable position to the retained closed position as shown in FIG. 8.

Figure 16:
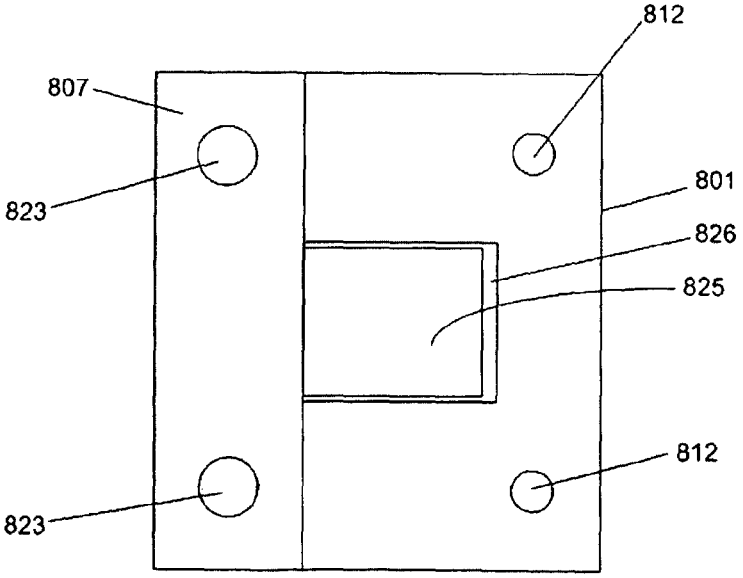
FIG. 16 illustrates a rear view of the first rear plate of FIG. 14.
Figure 17:
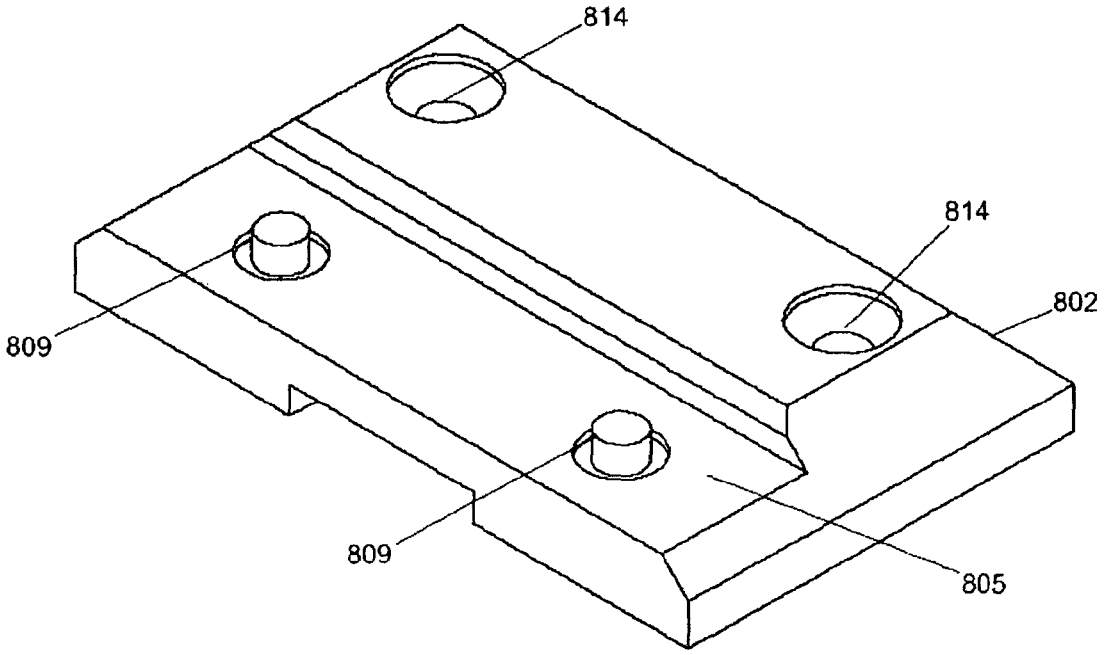
FIG. 17 illustrates a perspective view of the second rear plate of the second hinge member of the hinge of FIG. 8.
Figure 18:
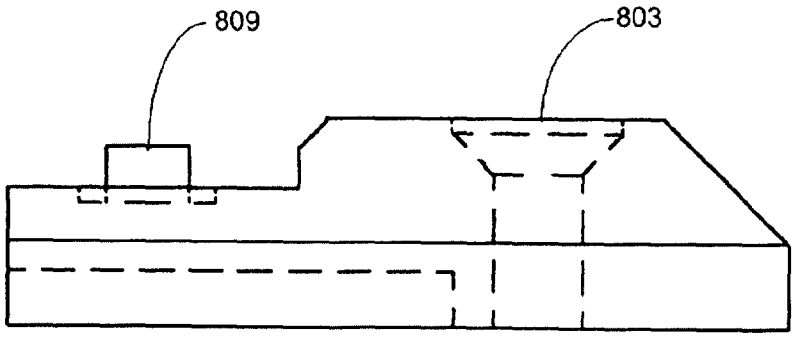
FIG. 18 illustrates a side view of the second rear plate of FIG. 17.
Figure 19:
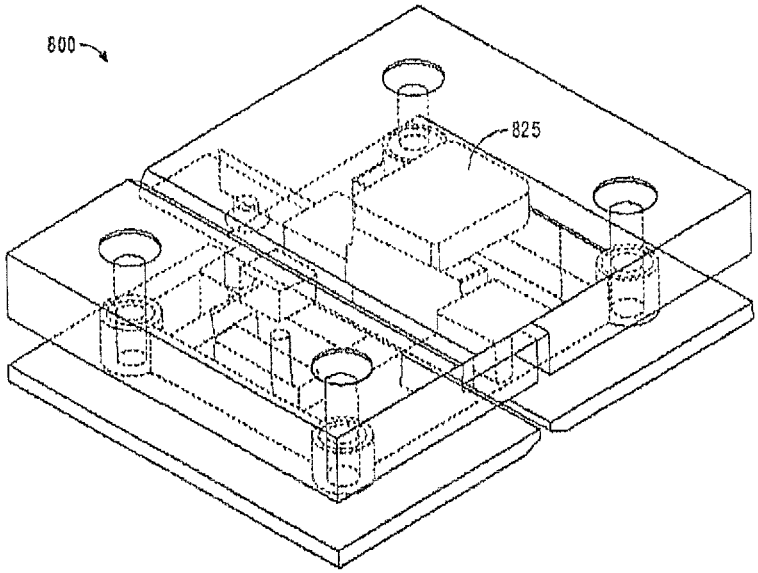
FIG. 19 illustrates a semi-transparent perspective view of the hinge of FIG. 8 outlining the positioning of the magnetic elements in the retained position.
Figure 20:
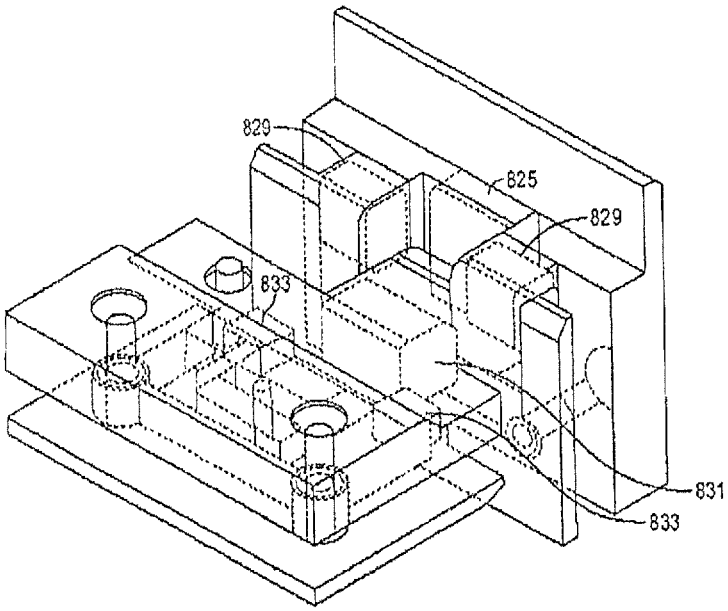
FIG. 20 illustrates a semi-transparent perspective view of the hinge of FIG. 8 outlining the positioning of the magnetic elements in the unretained position.
Figure 21:
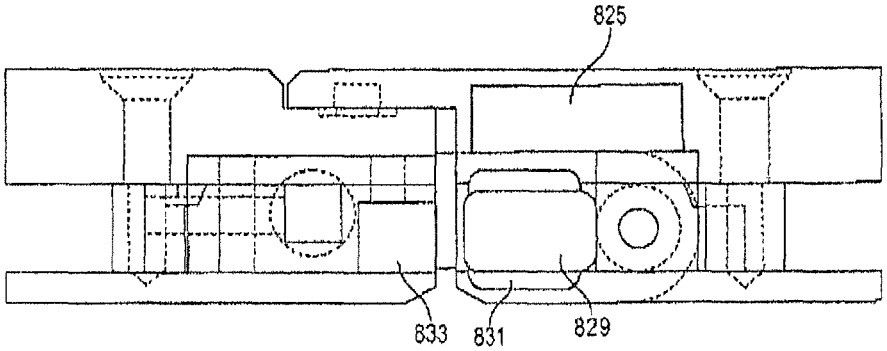
FIG. 21 illustrates a semi-transparent top view of the hinge of FIG. 8 outlining the positioning of the magnetic elements in the retained position.
Figure 22:
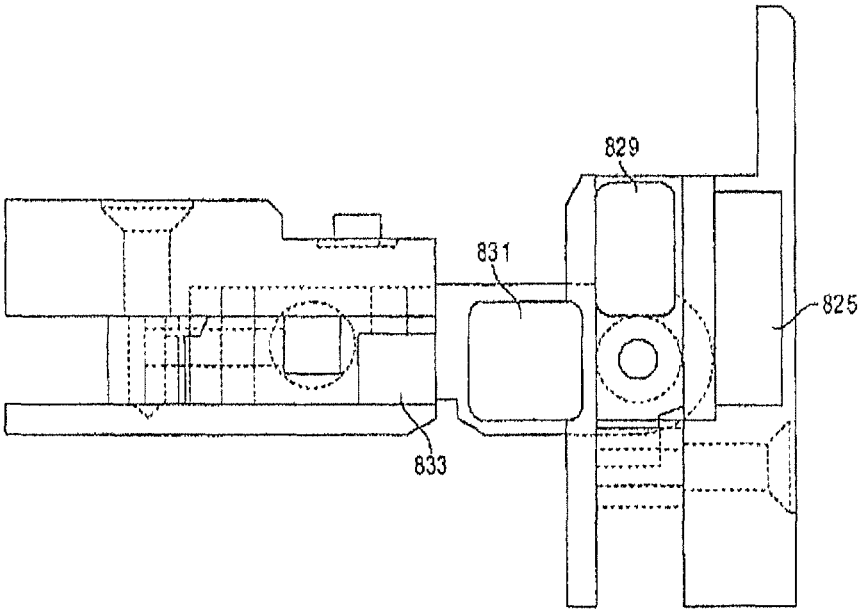
FIG. 22 illustrates a semi-transparent top view of the hinge of FIG. 8 outlining the positioning of the magnetic elements in the unretained position.

In particular, the one or more dampener elements 809 can be provided as a hydraulic mechanism 880, wherein a hydraulic piston protrudes outwardly from the recessed surface 805 of the rear plate 808 of the second hinge member 802. Referring to FIG. 16, when the hinge 800 moves from an unstable position to the closed retained position, an underside surface of the overlapping portion 807 of the rear plate 808 of the first hinge member 801 urges against the top of the hydraulic piston 809, causing at least a portion of the piston to gradually retract within a hydraulic cylinder, thereby slowing the movement of the hinge members 801, 802 to the retained closed position.

Figure 9:
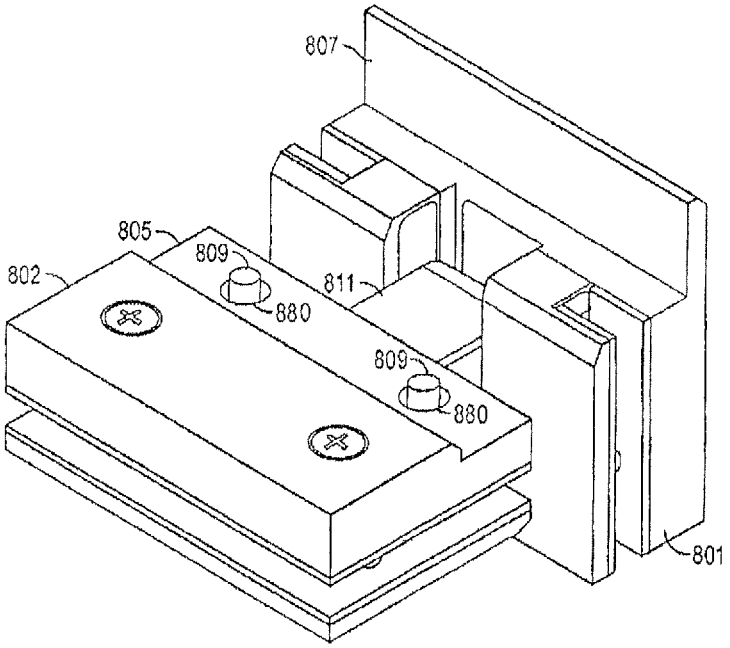
FIG. 9 illustrates a perspective drawing on the hinge of FIG. 8 in an unretained position.

When the first and second hinge members 801, 802 are moved to an unretained position, as shown in FIG. 9, such that the underside surface of the overlapping portion of the first hinge member is no longer in contact with the hydraulic pin, at least a portion of the hydraulic piston 809 extends from the hydraulic cylinder thereby resetting the dampening mechanism. The hydraulic mechanism 880 may include a biasing arrangement within the hydraulic cylinder, such as a spring or the like, which urges the piston to extend outwardly from the hydraulic cylinder more rapidly than the retraction of the cylinder within the hydraulic cylinder.

Referring to FIG. 16 there is shown the underside surface of the rear plate 804 of the first hinge member 801. As can be seen from FIG. 16, the underside surface of the overlapping portion of the front plate of the first hinge member may include one or more recesses 823 to house a top portion of the hydraulic mechanism 880 whilst the hinge is in the retained position. The underside surface of the rear plate 804 of the first hinge member 801 also includes an aperture 826 for tight fittingly receiving therein a magnetic element 825. The magnetic element 825 is located substantially in the middle of the underside of the rear plate 804 of the first hinge member 801.

Figure 10:
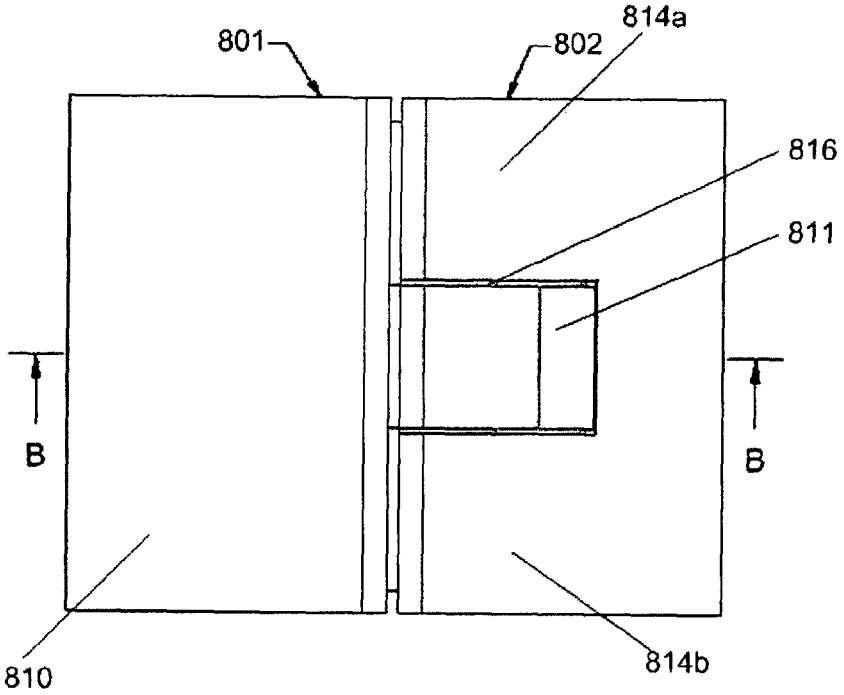
FIG. 10 illustrates a plan view of the hinge of FIG. 8 in the retained position.
Figure 11:
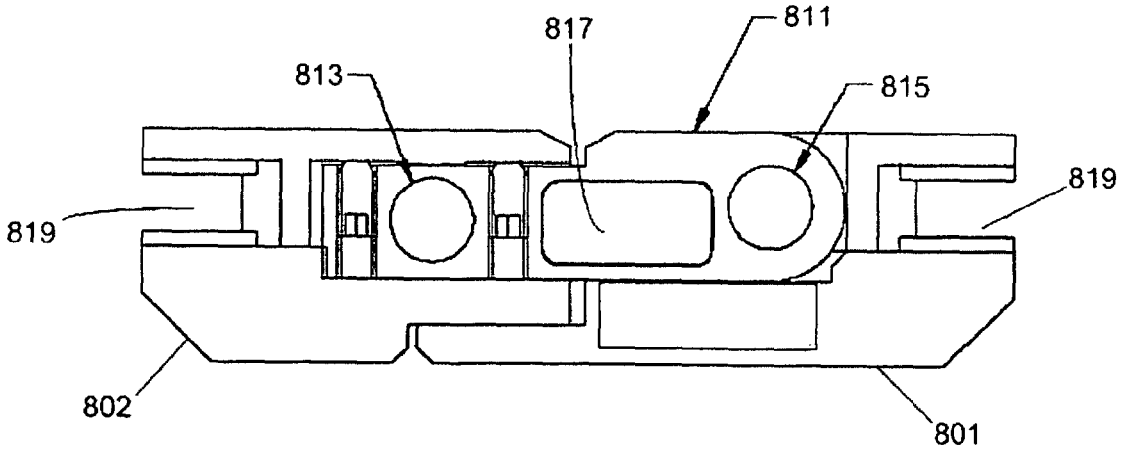
FIG. 11 illustrates a cross-sectional view through section line B-B of the hinge of FIG. 8 in the retained position.
Figure 12:
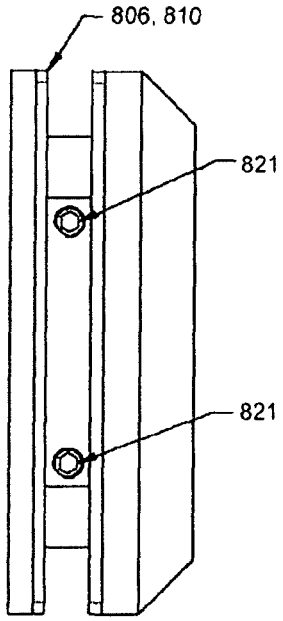
FIG. 12 illustrates a side view of the hinge of FIG. 8 in the retained position.
Figure 13:
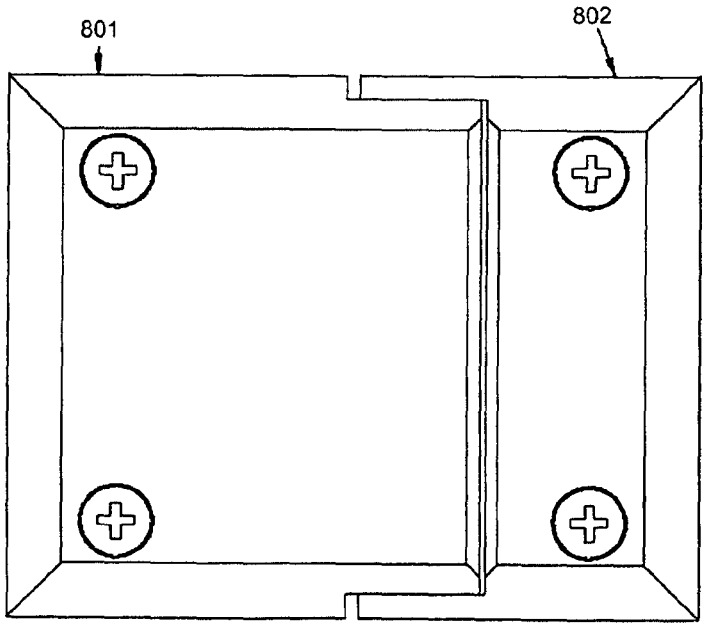
FIG. 13 illustrates a rear view of the hinge of FIG. 8 in the retained position.
Figure 14:
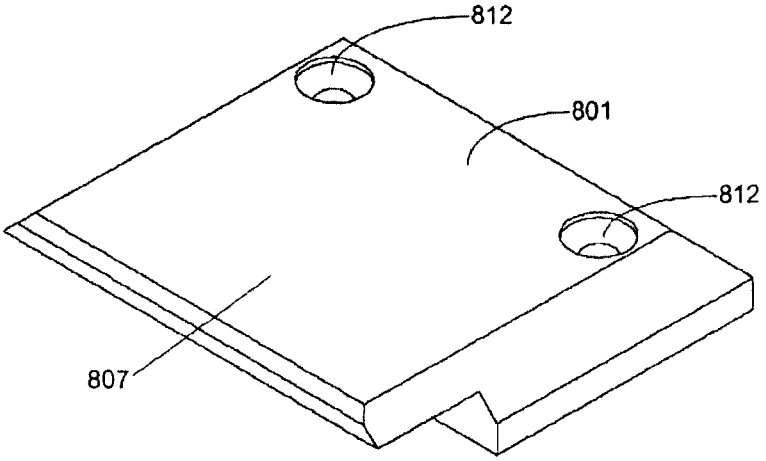
FIG. 14 illustrates the first rear plate of the first hinge member of the hinge of FIG. 8.
Figure 15:
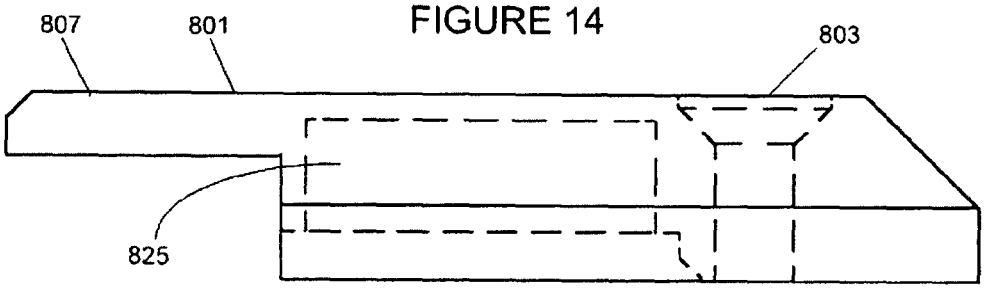
FIG. 15 illustrates a side view of the first rear plate of FIG. 14.

Referring to FIG. 10 there is shown a front view of the front plates 806, 810 of the first hinge member 801 and second hinge member 802. The front plate 806 first hinge member 801 includes a first and second arm 814*a*, 814*b* defining a gap 816 therebetween which a joining member 811 can pivot therethrough as will be described in more detail below.

Figure 25:
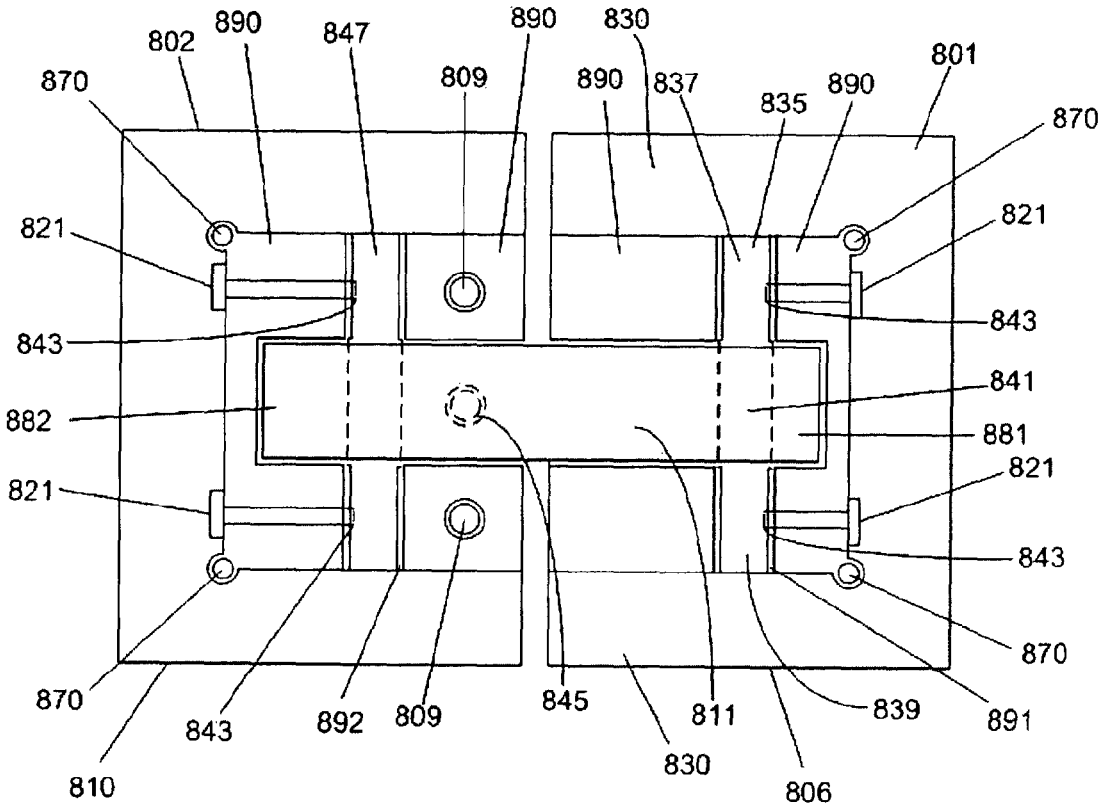
FIG. 25 illustrates the inner surface and retaining structure of the front hinge plates.

Referring to FIG. 25 there is shown the hinge with the rear plates 804, 808 of the first and second hinge member 801, 802 removed. The inner surface of the front plates 806, 810 include a retaining structure 890 for retaining the joining member 811 which pivotally joins the first and second hinge members 801, 802. The joining member 811, whilst retained between the front and rear plates 804, 806, 808, 810 of the first and second hinge members 801, 802 allows the first and second members 801, 802 to pivot relative to each other.

The joining member 811 includes a first end 881 which is retained by the first hinge member 801 and a second end 882 which is retained by the second hinge member 802. The first end 881 of the joining member 811 includes a rounded end forming a semi cylindrical end, as shown more clearly in FIG. 29. Whilst the hinge 800 in the closed retained position, a rear surface 875 of the first end 881 of the joining member 811 lays flush in the gap 816 with the front surface of the front hinge plate 806 of the first hinge member 801.

Figure 26:
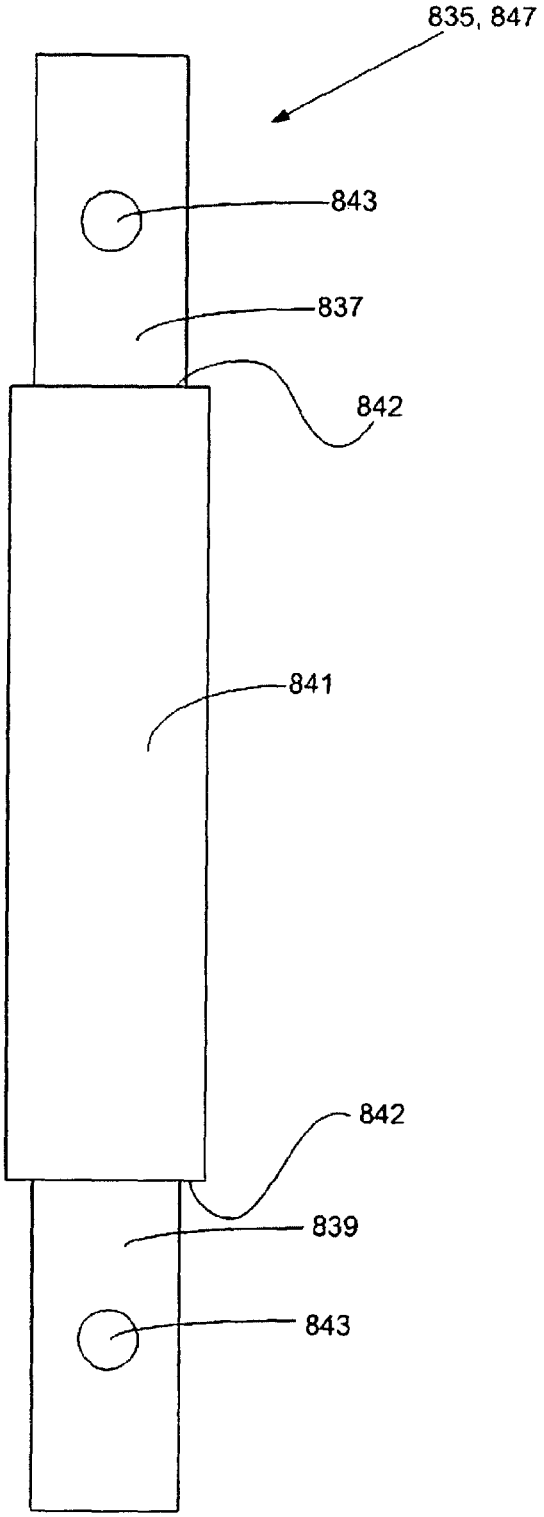
FIG. 26 illustrates a plan view of the first retaining pin of the hinge of FIG. 8.
Figure 27:
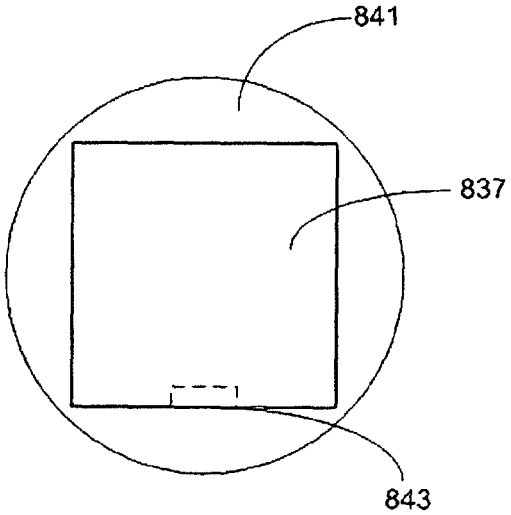
FIG. 27 illustrates a top view of the first retaining pin of FIG. 26.

The first end 881 of the joining member 811 includes a first hollow 876 which substantially extends along the axis of the semi cylindrical end of the joining member 811. The first hollow 876 has a cylindrical cross-section. A first retaining pin 835 is received through the first hollow 876, wherein a first end 837 and a second end 839 of the first retaining pin 835 protrudes from opposing ends of the first hollow 876. The first end 837 and second end 839 of the first retaining pin 835 have a square profile, as shown in FIGS. 26 and 27, which is received within correspondingly profiled first channel 891 of the retaining structure 890. A body section 841 located between the first and second end 837, 839 of the first retaining pin 835 includes a cylindrical profile, wherein the join between the body section and the first and second ends form a shoulder 842. Each shoulder 842 of the first retaining pin 835 rests against a rear edge of the front hinge plate 806, thereby assisting in securing the retaining pin 835 in the channel 891. As the first hollow 876 has a cylindrical profile which tight fittingly receives the first retaining pin 835, the body section 841 of the first retaining pin 835 is able to freely rotate within the first hollow 876 when the first hinge member 801 pivots relative to the second hinge member 802.

Referring to FIGS. 26 and 27, the first retaining pin 835 includes a pair of retaining grooves 843 located on an external facing surface of each end 837, 839 of the first retaining pin 835. Each retaining groove 843 has a circular profile. The retaining grooves 843 align with corresponding retaining apertures in a side portion of the retaining structure 890 when the first retaining pin 835 is placed within the first channel 891. Each retaining aperture includes a screw thread for receiving a coupling element 821 such as a grub screw or the like. The tail end of each coupling element rests within the retaining groove 843 of the pin 835, thereby securing the retaining pin 835 in the channel 891.

The second end 882 of the joining member 811 has a rectangular cross-section and can be releasably secured to the rear plate of the second hinge member via the retaining structure. However, it will be appreciated that the second end of the joining member can be fixed or integral with the front plate 810 of the second hinge member 802.

In one form, a second retaining pin 847 having similar characteristics to that of the first retaining pin 835 can be received through a second hollow 877 located at the second end 882 of the joining member 811. The second retaining pin 847 can be secured via one or more coupling elements 821 such as grub screws or the like as described above for the first retaining pin 835. Additionally, the shoulder formed between the cylindrical body section of the second retaining pin 847 and the first and second ends thereof rest against respective flanges formed by the retaining structure 890 to thereby assist in retaining the second retaining pin 847.

In one form, as shown in FIG. 25, a portion of the retaining structure can includes one or more threaded holes, each for receiving and releasably retaining an external thread of each hydraulic cylinder of each hydraulic mechanism. However, as shown in FIG. 25 with dotted lines is an alternate position where one or more dampening elements 809 may be located in the joining element 811. With both arrangements, the one or more threaded holes are located such that the overlapping mechanism overlays the protruding piston of the hydraulic mechanism 809 in the closed position.

Figure 23:
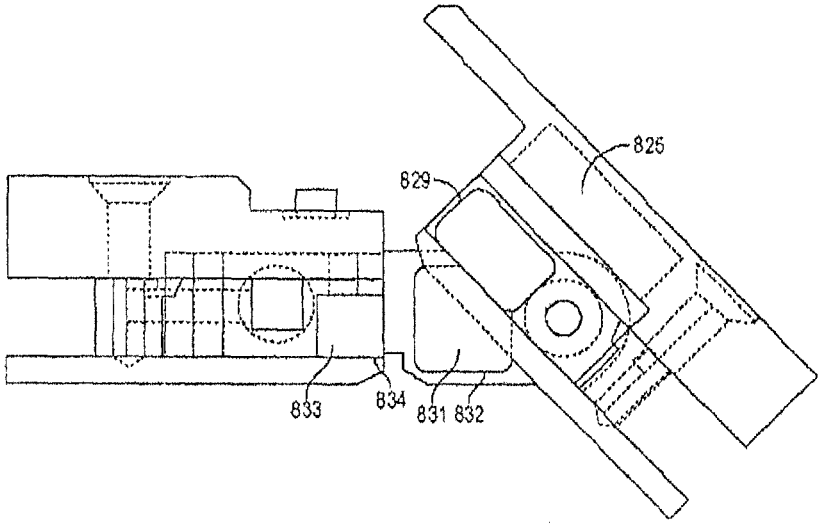
FIG. 23 illustrates a semi-transparent top view of the hinge of FIG. 8 outlining the positioning of the magnetic elements in another unretained position.
Figure 24:
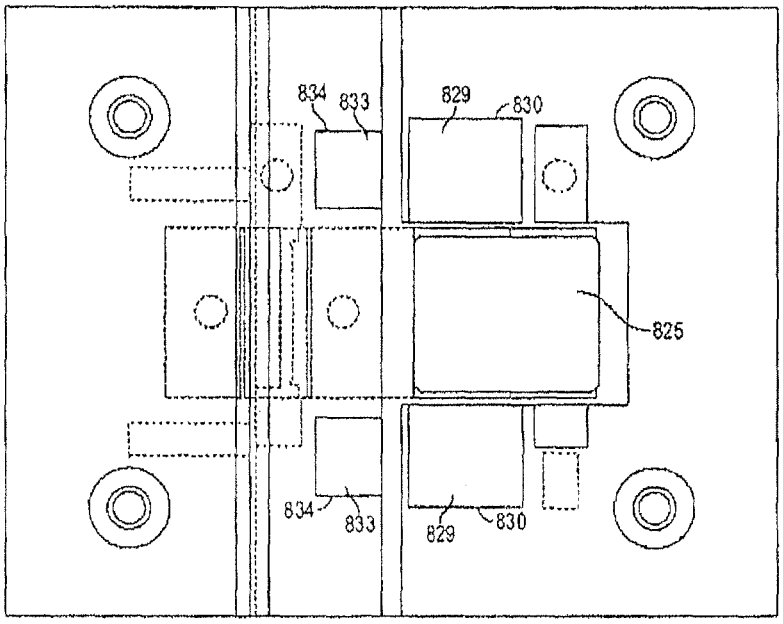
FIG. 24 illustrates a semi-transparent plan view of the hinge of FIG. 8 outlining the positioning of the magnetic element in the retained position.

Referring to FIGS. 23 and 24, there is shown a pair of aligned hollows 830 defining a side surface of the first channel 891. Each hollow 830 tight fittingly receives a magnetic element 829.

The joining member 811 includes a hollow 832 which aligns with the pair of hollows 830 whilst the hinge 800 is positioned in the retained position. The hollow 832 of the joining member 811 tight fittingly receives a magnetic element 831. The pair of magnetic elements 829 retained within the rear plate 804 of the first hinge member 801 biases, via magnetic attraction, the magnetic element 831 retained within the hollow 832 of the joining member 811, thereby retaining the hinge members 801, 802 in the retained position.

A pair of hollows 834 on the second front hinge plate 810 define a side surface of the second channel 892. Each hollow 834 can tight fittingly receive a magnetic element 833. The magnetic elements 833 retained within the hollows 834 additionally assist in biasing the hinge 800 to the retained position, and assist in retaining the hinge 800 in the retained position 800.

The magnetic element 825 located in the rear hinge plate of the first hinge member 801 is also attracted to the magnetic element 831 located within the hollow 832 of the pivoting member 811 such as to help retain the hinge in the closed position. In the retained position, the magnetic element 825 overlays the magnetic element 831. As will be appreciated, magnetic element 825 and magnetic element 831 are of different polarities to cause an attractive magnetic force, thereby biasing the hinge 800 to the retained position.

Figure 28:
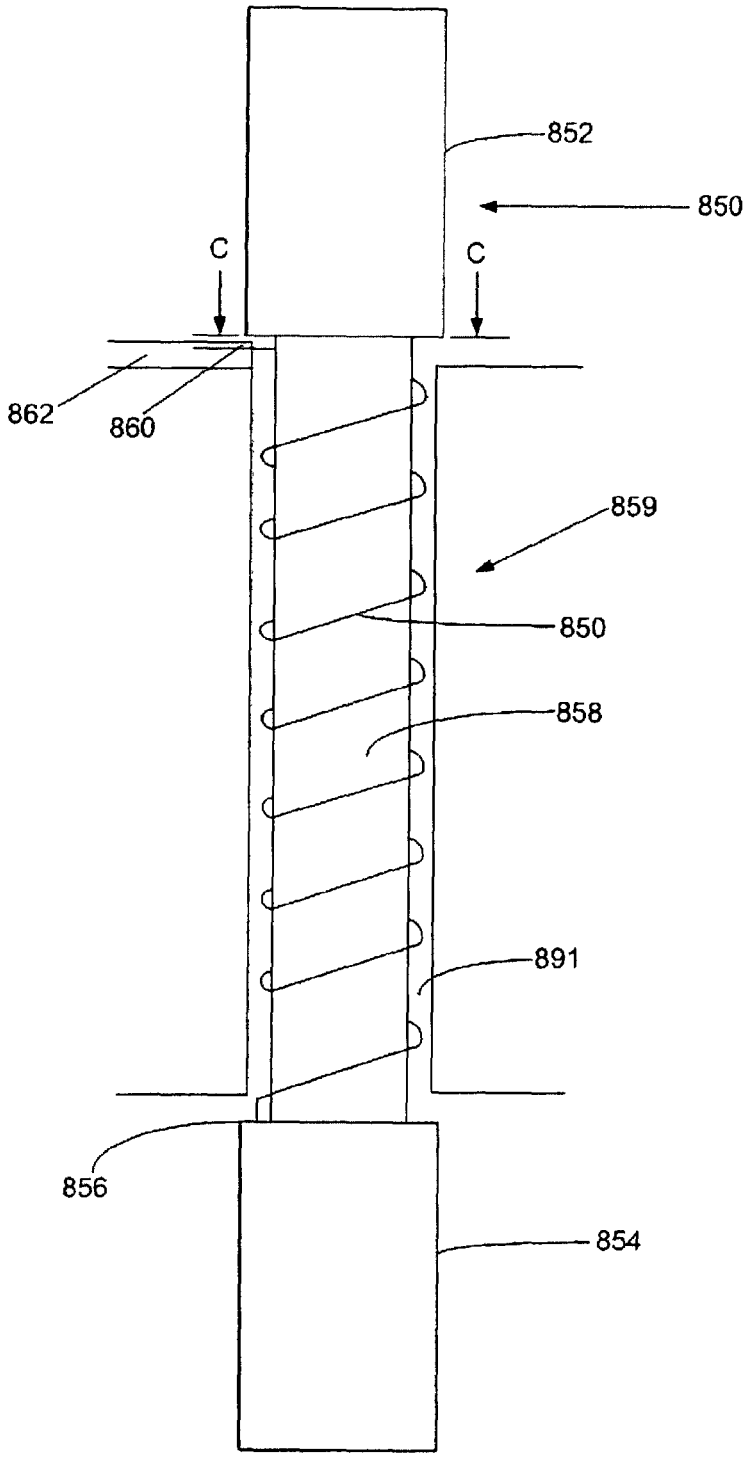
FIG. 28 illustrates sectional view the first retaining pin supporting a biasing arrangement which is protruding through the first hollow of the joining member.

Referring to FIG. 28 there is shown an alternate example of a first retaining pin 851. In particular, the first retaining pin 859 supports an additional biasing arrangement 859 to bias the first and second hinge members 801, 802 to the retained position.

Specifically, the first retaining pin 851 includes a first and second end 852, 854 which are substantially similar to that disclosed in FIGS. 26 and 27. However, the first retaining pin 851 includes a narrowed body section 858 relative to and located between the first and second ends 852, 854. A biasing element 850, such as a spring, is retained on the surface of the narrowed body section 858 of the first retaining pin 851. A first end of the spring 856 is fixed to the retaining pin 851, specifically a shoulder defined between the second end 854 of the pin 851 and the body section 858. A second end 860 of the spring 850 protrudes from one of the ends of the hollow 891 of the joining member 811. The second end 860 of the spring 850 is buttable against a stop 862 on a top surface of the joining member 811.

Figure 29:
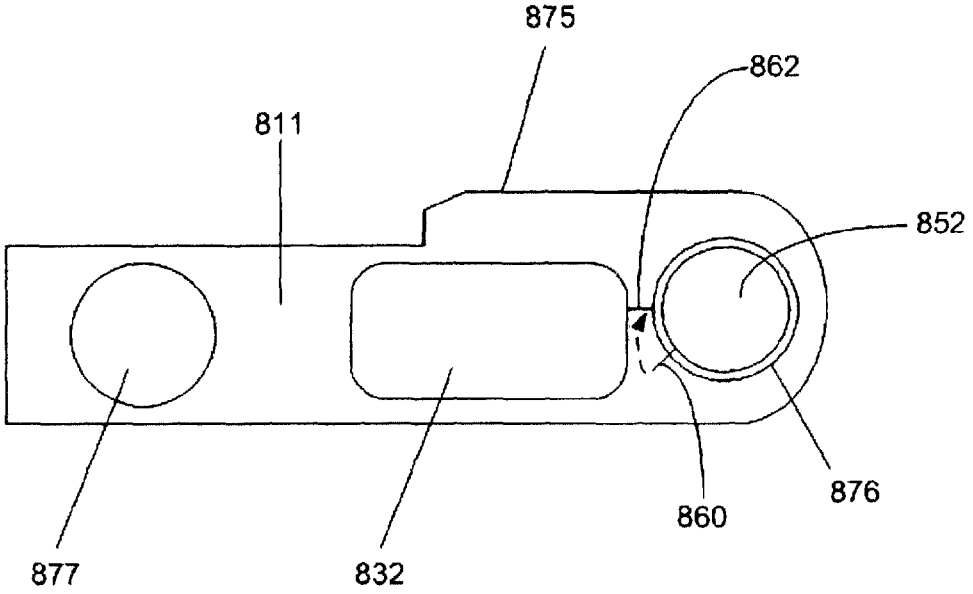
FIG. 29 illustrates a cross-sectional view of the first retaining pin protruding through the first hollow of the joining member of FIG. 28.

As the first hinge member 801 begins to pivot relative to the second hinge member 802, the first and second ends 856, 860 of the spring fail to move relative to each other until the second end 860 comes into contact with the stop surface 862 as clearly shown in FIG. 29. Once the second end 860 comes into contact with the stop surface 862 and the first and second hinge members 801, 802 continues to pivot away from the retained state and relative to each other, the first channel 891 of the retaining structure applies torque to the first and second ends 852, 854 of the first retaining pin 851, thereby causing the first end of the spring 856 begins to rotate relative to the second end 860 of the spring 850, causing potential energy to build and be stored in the spring 850. The potential energy thereby biases the hinge members 801, 802 in an opposite direction back toward the retained position.

The first and/or second ends 852, 854 of the first retaining pin 859 may be releasably attached to the body section 858 of the first retaining pin 859 so as to place the spring 850 over the body section 858 of the pin 859 whilst retaining the spring 850 on the body section 858 of the retaining pin 859 when the first and/or second ends 852, 854 are releasably attached.

As illustrated by FIG. 29, the second end 860 of the spring 850 may not butt against the stop surface 862 until the first hinge member 801 pivots through thirty degrees of rotation relative to the retained position. Upon the first hinge member 801 pivoting thirty degrees of rotation relative to the retained position, the second end 860 of the spring 850 butts against the stop surface 862, thereby causing the tension in the spring 850 to build. Whilst the first hinge member has rotated below thirty degrees of rotation relative to the closed position, the magnetic elements 831, 833, 825, 829 cause a magnetic attractive force, thereby causing the first and second hinge members to be biased toward the retained position.

The hinge disclosed by FIG. 8 through to 29 is ideally suited for a pool fence hinge as it biases the hinge toward the closed when the hinge members are moved from the retaining position via the biasing mechanism of the magnetic elements and the spring of the first retaining pin. It will be appreciated that only a portion of magnetic elements 831, 833, 825, 829 may be required in order to retain the first and second hinge member 801, 802 in the retained state. In particular, for the pool hinge application, the hinge may only require magnetic elements 825 and 831. However, for other applications, such as a shower screen hinge, the hinge may only require magnetic elements 831 and 829. It will be appreciated that other applications of the hinge 100, 800 are possible.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Although a preferred embodiment has been described in detail, it should be understood that various changes, substitutions, and alterations can be made by one of ordinary skill in the art without departing from the scope of the present invention.

The invention claimed is:

1. A hinge including:

a first hinge member including a first magnetic element and an overlapping portion;

a second hinge member including a second magnetic element, wherein the first and second hinge members are hingedly mounted to each other;

a biasing mechanism, separate from the first magnetic element and the second magnetic element, configured to bias the first hinge member and the second hinge member toward a retained position, wherein the biasing mechanism is a spring; and a dampening mechanism configured to slow the movement of the first hinge member relative to the second hinge member, wherein a portion of the dampening mechanism protrudes from a face of the second hinge member when the hinge is moved away from the retained position, and wherein when the first and second hinge members pivot relative to each other toward the retained position the overlapping portion overlaps the face of the second hinge member and urges against the dampening mechanism, thereby slowing the movement of the first hinge member and the second member to the retained position, wherein the overlapping portion abuts the face of the second hinge member when in the retained position;

wherein magnetic attractive force between the first and second magnetic elements contribute toward maintaining the first and second hinge members in the retained position.

2. The hinge according to claim 1, wherein the first and second magnetic elements bias, via said magnetic attractive force between said first and second magnetic elements, the first and second hinge members to the retained position.

3. The hinge according to claim 1, wherein the dampening mechanism is a hydraulic mechanism.

4. The hinge according to claim 3, wherein the hydraulic mechanism includes a hydraulic piston which substantially protrudes from the second hinge member, and wherein when the first and second hinge elements move toward the retained position, the overlapping portion urges against the hydraulic piston which gradually retracts into a hydraulic cylinder of the hydraulic mechanism.

5. The hinge according to claim 4, wherein the hydraulic mechanism is spring loaded to eject a portion of the piston from the cylinder once the first and second hinge members move from the retained position to an unretained position.

6. The hinge according to claim 1, wherein the hinge includes a joining member which pivotally joins the first hinge member to the second hinge member.

7. The hinge according to claim 6, wherein a first retaining pin extends through and is releasably retained within a first hollow of the joining member to thereby releasably secure the joining member in pivotal connection, about the first retaining pin, with the first hinge member.

8. The hinge according to claim 7, wherein the first retaining pin supports the spring, wherein a first end of the spring is attached to the retaining pin and a second end of the spring butts against a stop surface of the joining member, wherein pivotal movement of the first and second members away from the retained position causes potential energy to build in the spring, thereby biasing the first and second hinge members toward the retained position.

9. The hinge according to claim 8, wherein a second retaining pin extends through and is releasably retained within a second hollow of the joining member to thereby releasably fix the joining member to the second hinge member.

10. The hinge according to claim 6, wherein the joining member includes a third magnetic element, and wherein an attractive magnetic force between the first magnetic element and the third magnetic element contributes toward maintaining the first hinge member and second hinge member in the retained position.

11. The hinge according to claim 1, wherein the first hinge member includes a first hinge front plate and a first hinge rear plate which are releasably secured together, and the second hinge member includes a second hinge front plate and a second hinge rear plate which are releasably secured together.

12. The hinge according to claim 1, wherein the first hinge member includes at least one aperture to receive and retain the first magnetic element.

13. The hinge according to claim 1, wherein the second hinge member includes at least one aperture to receive and retain the second magnetic element.

14. The hinge according to claim 1, wherein the first hinge member includes an aim which extends from a first hinge body of the first hinge member, and the second hinge member includes a pair of arms which extend from a second hinge body, wherein the pair of arms define a recess which corresponds to the arm of the first hinge member, wherein the arms of the first and second hinge members include the first and second magnetic elements respectively.

15. The hinge according to claim 14, wherein the first and second magnetic elements retained by the arms of the first and second hinge members are superposed when the first and second hinge members are maintained in the retained position.

16. The hinge according to claim 1, wherein the first hinge member includes a first series of first magnetic elements of varying magnetic strength, wherein the first series of first magnetic elements include the first magnetic element, and the second hinge member includes a second series of second magnetic elements of varying magnetic strength, wherein the second series of second magnetic elements include the second magnetic element, wherein the first and second series of magnetic elements contribute to control the speed which the first and second hinge members pivotally move toward the retained position.

17. The hinge according to claim 1, wherein the dampening mechanism protrudes from the face of the second hinge member in a direction substantially normal to the face of the second hinge member.

18. A hinge including:

a first hinge member including a first magnetic element;

a second hinge member including a second magnetic element, wherein the first and second hinge members are hingedly mounted to each other; and a biasing mechanism, separate from the first magnetic element and the second magnetic element, configured to bias the first hinge member and the second hinge member toward a retained position;

wherein magnetic attractive force between the first and second magnetic elements contribute toward maintaining the first and second hinge members in the retained position;

wherein the first and second hinge members are hingedly connected via a hinge pin, wherein the biasing mechanism is supported upon the hinge pin, wherein a first end of the biasing mechanism is attached to the hinge pin and a second end of the biasing mechanism butts against a stop surface of the hinge, wherein movement of the first and second hinge members away from the retained position causes potential energy to build in the biasing mechanism, thereby biasing the first and second hinge members toward the retained position.

19. The hinge according to claim 18, wherein the biasing mechanism is a spring.

20. A hinge including:

a first hinge member including a first magnetic element and an overlapping portion;

a second hinge member including a second magnetic element, wherein the first and second hinge members are hingedly mounted to each other;

a biasing mechanism, separate to the first magnetic element and the second magnetic element, configured to bias the first hinge member and the second hinge member toward a retained position, wherein the biasing mechanism is a spring; and a dampening mechanism configured to slow the movement of the first hinge member relative to the second hinge member, wherein a portion of the dampening mechanism protrudes from the second hinge member when the hinge is moved away from the retained position, and when the first and second hinge members pivot relative to each other toward the retained position, the overlapping portion urges against the dampening mechanism, thereby slowing the movement of the first hinge member and the second member to the retained position;

wherein magnetic attractive force between the first and second magnetic elements contribute toward maintaining the first and second hinge members in the retained position, and wherein the first hinge member and the second hinge member are parallel in the retained position.

* * * * *

UNITED STATES PATENT AND TRADEMARK OFFICE

CERTIFICATE OF CORRECTION

PATENT NO. : 9,121,207 B2
APPLICATION NO. : 13/057405
DATED : September 1, 2015
INVENTOR(S) : Stuart It is certified that error appears in the above-identified patent and that said Letters Patent is hereby corrected as shown below:

On the Title Page:

Item [60], delete "Provisional application No. 60/954,254, filed on Aug. 6, 2007."

In the Claims:

Column 11, claim 14, line 65, replace "aim" with --arm--

Signed and Sealed this
Twenty-second Day of March, 2016

Michelle K. Lee

Michelle K. Lee
*Director of the United States Patent and Trademark Office*